United States Patent [19]

Kitamura et al.

[11] Patent Number: 4,638,710

[45] Date of Patent: Jan. 27, 1987

[54] PERIODIC WAVEFORM GENERATION BY NONRECYCLICALLY READING LOWER FREQUENCY AUDIO SAMPLES AND RECYCLICALLY READING HIGHER FREQUENCY AUDIO SAMPLES

[75] Inventors: Masatsugu Kitamura, Atsugi; Kikuji Wagatsuma, Sagamihara; Tokumi Watanabe, Tokyo; Naoki Yamashita, Tokyo; Hiroshi Yoshida, Tokyo, all of Japan

[73] Assignee: Victor Company of Japan, Ltd., Japan

[21] Appl. No.: 667,622

[22] Filed: Nov. 2, 1984

[30] Foreign Application Priority Data

Nov. 5, 1983 [JP] Japan ..... 58-207982

[51] Int. Cl.[4] ..... G10H 1/02; G10H 7/00

[52] U.S. Cl. ..... 84/1.26; 84/1.13; 84/1.22

[58] Field of Search ..... 84/1.13, 1.22, 1.26, 84/DIG. 12

[56] References Cited

U.S. PATENT DOCUMENTS

| | | | |
|---|---|---|---|
| 4,383,462 | 5/1983 | Nagai et al. | 84/1.26 |
| 4,442,745 | 4/1984 | Gross et al. | 84/1.26 X |
| 4,502,361 | 3/1985 | Viitanen et al. | 84/1.26 |
| 4,520,708 | 6/1985 | Wachi | 84/1.26 |
| 4,524,666 | 6/1985 | Kato | 84/1.26 X |

FOREIGN PATENT DOCUMENTS

| | | |
|---|---|---|
| 3247599 | 7/1983 | Fed. Rep. of Germany . |
| 3430850 | 3/1985 | Fed. Rep. of Germany . |

*Primary Examiner*—Stanley J. Witkowski

*Attorney, Agent, or Firm*—Lowe, Price, LeBlanc, Becker & Shur

[57] ABSTRACT

An electronic musical instrument includes a first memory in which audio samples of lower frequency components of an aperiodic waveform are stored and a second memory in which audio samples of a higher frequency components of the waveform are stored. Digital samples stored in a first portion of the second memory represent a rapidly rising portion of the higher frequency waveform and those stored in a second portion of the memory represent a rapidly declining portion of the higher frequency waveform whose amplitude and spectral energy distribution profiles are preferably equalized. The first memory is addressed throughout in forward scan to generate a first output waveform. The second memory is addressed in an initial forward scan throughout its first and second portions and the direction of scan is reversed at the end of the second portion to recyclically address it in rearward and forward directions to generate a second output waveform, which is combined with the first output waveform. A monotonically declining envelope is preferably impressed upon the second output waveform to reconstruct the original declining amplitude and spectral energy distribution profile.

6 Claims, 6 Drawing Figures

PERIODIC WAVEFORM GENERATION BY NONRECYCLICALLY READING LOWER FREQUENCY AUDIO SAMPLES AND RECYCLICALLY READING HIGHER FREQUENCY AUDIO SAMPLES

BACKGROUND OF THE INVENTION

The present invention relates generally to electronic musical instruments, and in particular to an electronic musical instrument which generates an aperiodic musical waveform from a plurality of digital amplitudes corresponding to sample points in the original aperiodic waveform.

It is known to construct an electronic musical instrument using a digital memory in which an audio waveform is stored in sampled form. The stored audio waveform is conventionally read out of the memory at a constant rate in response to an address counter and is then converted to an analog signal by a digital-to-analog converter. In systems of this type it is desirable to store the digital samples using as few binary digits as possible in order to minimize the cost of the memory. In the case of periodic waveforms, it is common to store digital samples defining only one period of the waveform, the remainder of the waveform being derived through calculations performed on the, stored samples. Audio waveforms which are not of a periodic nature, such as complex percussive waveforms which decay gradually with time, cannot, however, be treated in this manner. In order to faithfully reproduce such waveforms using the sequential sampling technique, it is necessary to store substantially the entire waveform in sampled form.

Percussive waveforms have a rapidly rising portion generated in response to the occurrence of a crash of cymbals, for example, and an exponentially declining portion which rapidly decreases at first and then decays more and more slowly with time. The early stages of the waveform have a larger harmonic content than the later stages of the waveform. One approach that has hitherto been proposed involves storing the early stages of the waveform in digital form by eliminating the exponentially declining tail portion and reading the stored digital samples in a forward scan at first and then recyclically repeating forward and rearward scans to read a portion of the memory having a lesser harmonic content. Since the capacity of the memory needed to store such waveforms is determined by the number of bits required to resolve the highest peak of the waveform multiplied by the number of sample points on the time axis and since the recycled portion of the stored data occupies a smaller part of the memory, the memory utilization of the proposed system is still not satisfactory.

SUMMARY OF THE INVENTION

Accordingly, the present invention provides an electronic musical instrument wherein a memory is utilized to the fullest capacity.

According to the invention, an original percussive waveform is separated into lower frequency components and higher frequency components and respectively sampled at low and high frequencies. The frequency by which said low and high frequency components are divided is selected so that phase variations which may occur in the higher frequency components are unnoticeable to human ears. The lower frequency audio samples are stored at sequentially addressible locations of a first memory and the higher frequency audio samples are stored in sequentially addressible locations of a second memory such that the audio samples derived from a rapidly rising portion of the higher frequency components are stored in a first portion of the second memory and a rapidly decaying portion of the higher frequency components are stored in a second portion of the second memory. In a readout mode, the first memory is sequentially addressed at a lower rate in a forward scan to read the stored audio samples. The second memory is sequentially addressed at a higher rate throughout its first and second portions in the initial forward scan. The direction of scan is reversed at the end of the second portion of the memory to read the second portion in rearward scan. The direction of scan is again reversed at the initial point of the second portion and the process is repeated to recyclically read out the audio samples of the rapidly decaying portion. The audio samples read out of the first and second memories are combined to reconstruct the original aperiodic waveform.

The separation of lower frequency components from the recylically addressed higher frequency components provides features which are improvements over the prior art waveform generation technique. The primary improvement of the present invention lies in the elimination of noticeable phase variations which result in unrealistic percussive sound. Further, the frequency separation approach enables the lower frequency components to be sampled at a lower rate which requires a small capacity memory.

Preferably, the audio samples of the rapidly decaying portion are equalized in amplitude and spectral energy distribution profile prior to storage in the second memory and an exponentially declining envelope is impressed upon the amplitude and spectral energy distribution profile of the audio samples read out of the second portion of the second memory. The equalization of amplitudes and spectral characteristic and the recycled back-and-forth scan reading of the equalized digital samples permit full utilization of a memory and result in an improvement in signal-to-noise ratio. The aperiodic waveform generator of the invention thus requires a memory having a smaller capacity than is required by prior art waveform generators.

BRIEF DESCRIPTION OF THE DRAWINGS

The present invention will be described in further detail with reference to the accompanying drawings, in which.

DETAILED DESCRIPTION

Figure 1:
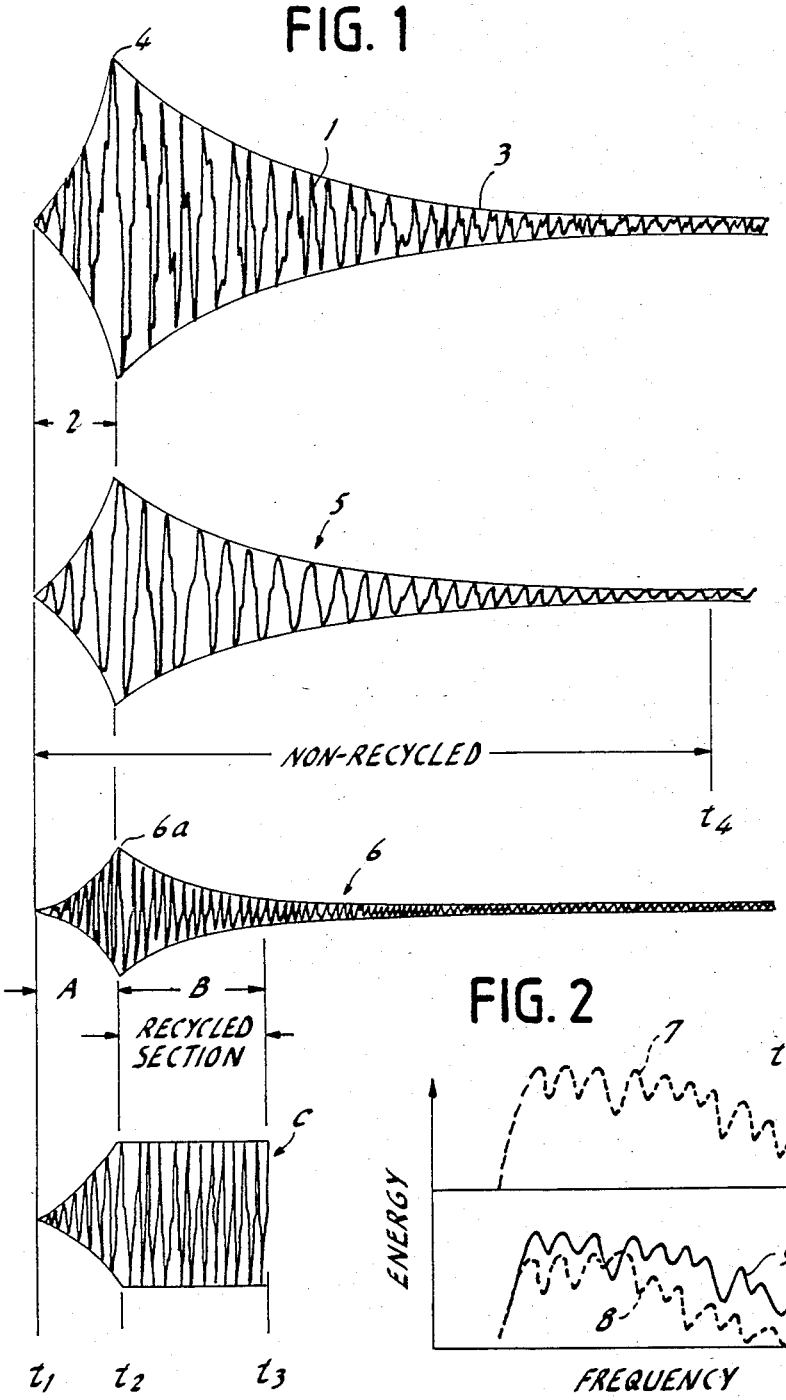
FIG. 1 shows a portion of an original percussive waveform and waveforms of separated low and high frequency components of the original.
Figure 2:
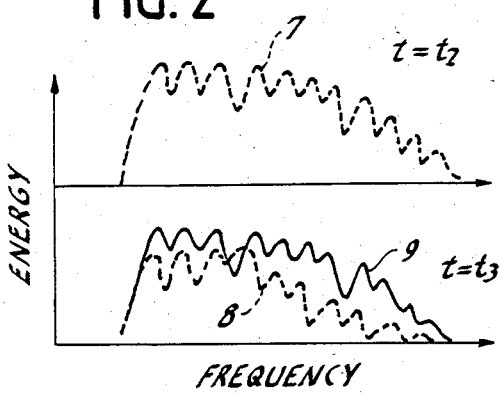
FIG. 2 shows spectral energy distribustin profiles of the higher frequency components.

In FIG. 1, the waveform 1 depicts an oscillating voltage which represents a percussive musical sound which is encountered when there is a clash of cymbals. The envelope of the voltage has a sudden onset 2 and a very long exponential decay 3. The envelope rises in response to the occurrence of a percussive event at time $t_1$ to a peak 4 at time $t_2$ and then decays rapidly at first, and then more and more slowly as the waveform continues. There is a larger content of higher harmonics in the rapidly rising portion of the higher frequency waveform 6 than there is during the remaining portion of the exponential decay. The waveform 1 has a different spectral characteristic at each sample point on the time axis of the waveform such that higher harmonic content decreases monotonically with time. A dashed line curve 7 in FIG. 2 indicates the spectral energy distribution at sample point $t_2$ of waveform 6 and a dashed line curve 8 indicates the energy distribution at sample point $t_3$ having a lesser content of higher harmonics than at sample point $t_2$.

The waveform generation technique according to the present invention involves separating the original percussive waveform into low frequency components having frequencies lower than 1000 Hz and high frequency components having frequencies higher than 1000 Hz, as shown at 5 and 6, respectively. The lower frequency waveform 5 is sampled at 2000 Hz, twice the highest frequency of the lower,frequency band and the higher frequency waveform 6 is sampled at 40 kHz, twice the highest frequency of the audio spectrum. A portion of the audio samples of lower frequency components 5 from $t_1$ to $t_4$ is stored into a first memory. On the other hand, the exponential decay section of the audio samples of higher frequency waveform 6 from time $t_3$ to $t_4$ is eliminated and the remaining early section of the samples from time $t_1$ to $t_3$ is stored into a second memory. This early section of waveform 6 has a rising portion A which rapidly rises at $t_1$ to a peak 6*a* at time $t_2$ and a rapidly decaying portion B from time $t_2$ to $t_3$.

In a preferred embodiment of the present invention, the rapidly decaying portion of waveform 6 is equalized in amplitude to the amplitude of peak 6*a* and the spectral energy distribution of section B is equalized at all sample points to the spectral energy distribution at sample point $t_2$ as indicated by solid-line curve 9 using Fast Fourier Transform. The rising waveform section A and the amplitude and frequency equalized waveform section B are combined to provide a waveform shown at C, which is stored in sequentially addressible locations of the second memory.

Figure 3:
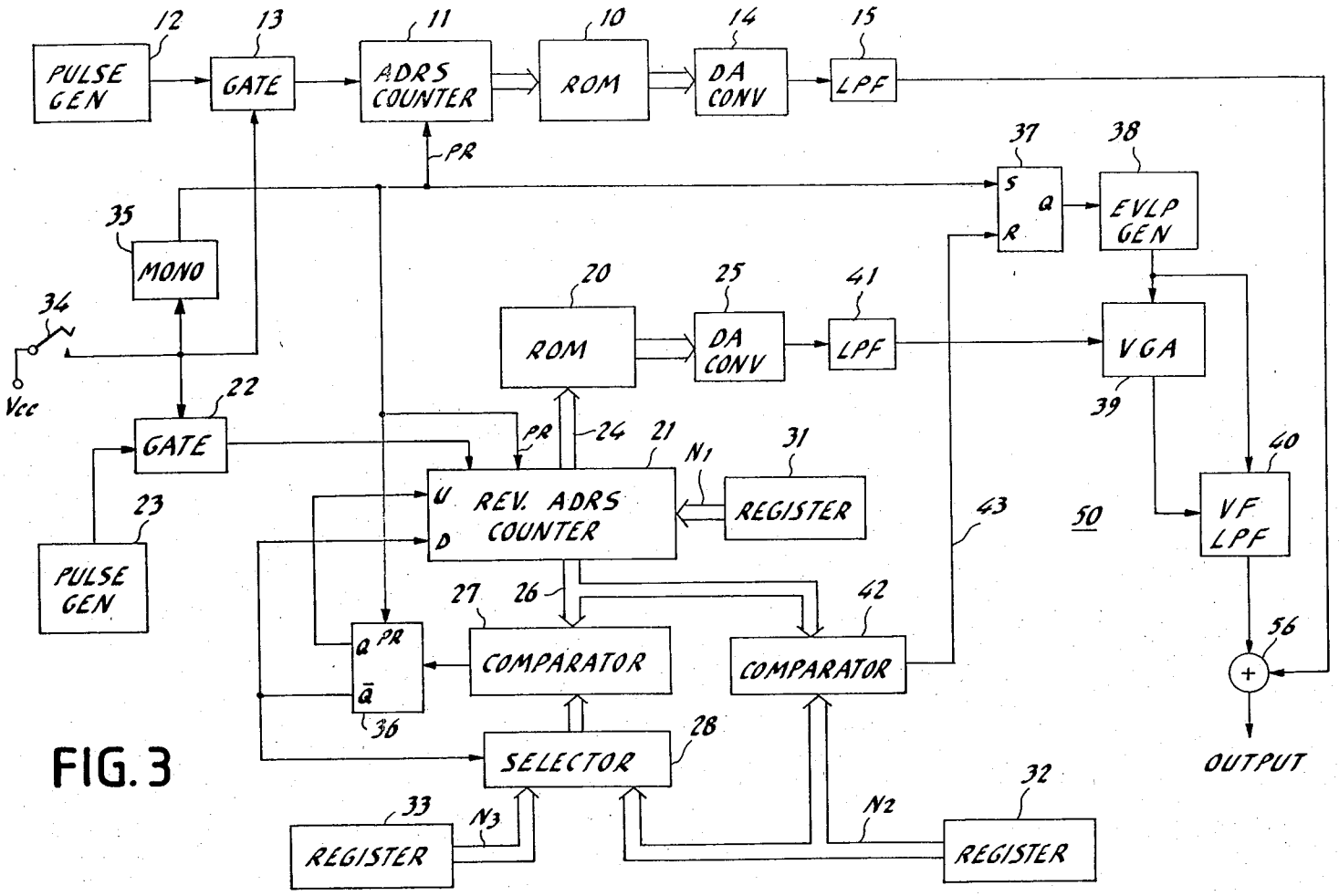
FIG. 3 is a block diagram of the electronic musical instrument according to an embodiment of the present invention.

FIG. 3 illustrates a block diagram of an aperiodic musical waveform generator according to an embodiment of the invention. In FIG. 3, the waveform generator includes a first waveshape memory 10, or read-only memory in which the digital amplitudes of lower frequency waveform section 5 from $t_1$ to $t_4$ are stored and a second waveshape memory 20 in which the digital amplitudes of the equalized waveform section C are stored. First memory 10 is sequentially addressed by an address counter 11 which is clocked at 2 kHz by clock pulses supplied from a pulse generator 12 through a gate 13 to read out the stored digital samples of the original low frequency waveform section 5, which are fed to a digital-analog converter 14 and filtered through a low-pass filter 15 to a summing point 56.

The digital amplitudes of the rising section A are stored in sequentially addressible locations of a first portion of memory 20 and those in the equalized section B are stored in sequentially addressible locations of a second, recycled portion of the memory 20. The digial peak amplitudes stored in the recycled portion of the memory are the same and the spectral characteristics of the digital amplitudes stored in this recycled portion are equalized. These memory addresses are sequentially accessible by corresponding address codes developed on bus 24 by a reversible address counter 21 which is stepped at 40 kHz through its successive count states by a clock signal supplied through a gate 22 from a clock pulse generator 23. The same address codes are sequentially developed on bus 26 and applied to a digital comparator 27 for comparison with boundary address counts $N_2$ and $N_3$ presented from the one of registers 32 and 33 which is selected by a selector 28.

The gates 13 and 22 are open in response to operation of a key 34 to apply respective clock pulses to address counters 11 and 21. The operation of key 34 also triggers a monostable multivibrator 35 which in turn presets address counter 11 to an initial address count $N_0$ and also presets address counter 21 to an initial address count $N_1$ provided from a register 31. The initial address count $N_0$ corresponds to the memory location of waveshape memory 10 in which the digital amplitude at sample point $t_1$ is stored and the initial address count $N_1$ likewise corresponds to the memory location of waveshape memory 20 in which the digital amplitude at sample point $t_1$ is stored. Register 31 could, of course, be dispensed with if the digital amplitude at $t_1$ is stored in zero address location of memory 20 and reversible address counter 21 is initially preset to zero address count.

The output of monostable multivibrator 35 is also applied to the prest input of a flip-flop 36 and to the set input of a flip-flop 37 of an envelope impression circuit 50. The signal on the true output of flip-flop 36 now goes high and sets the reversible counter 21 to upward count mode and the signal on the complementary output of flip-flop 36 goes low and causes selector 28 to apply the boundary address count $N_3$ from register 33 to comparator 27.

Counter 21 starts incrementing its count in response to the gated 40-kHz clock pulses beginning with the initial count state $N_1$ to sequentially scan the address field of waveshape memory 20. Digital amplitudes corresponding to address counts $N_1$ through $N_2$ are sequentially read out of the first portion of memory 20 as counter 21 is stepped through its count states in upward direction and those corresponding to address counts $N_2$ through $N_3$ are read out of the second portion of memory 20 as counter 21 is further incremented in the upward direction.

When counter 21 develops an address count on bus 26 corresponding to boundary address $N_3$ during the initial forward scan, there is a correspondence between the outputs of counter 21 and register 33 and comparator 27 provides an equality pulse to flip-flop 36. The complementary output of flip-flop 36 goes high and sets the counter 21 into downward count mode and causes selector 28 to apply the boundary address count $N_2$ to comparator 27.

Counter 21 initiates decrementing its count beginning with memory location $N_3$ to rescan the waveshape memory 20 in the opposite direction. Digital amplitudes stored in the recycled portion of the address field of memory 20 are rescanned in a rearward direction. Comparator 27 provides an equality pulse when amplitude instruction on location $N_2$ is read from memory 20. Counter 21 reverses its count direction and selector 28 switches to register 33. This process is repeated as long as the key 34 is depressed, producing a series of alternately reversed versions of waveform section B. The digital amplitudes sequentially read out of memory 20 are applied to a digital-to-analog converter 25 to produce a series of analog amplitudes in step with the clock pulses. A low-pass filter 41 integrates the analog amplitudes so that transitions between successive analog amplitudes at sample points are smoothed.

The aperiodic waveform generator of the present invention further includes a second comparator 42 which takes its inputs from reversible counter 21 and register 32. In the initial upward count beginning with initial address $N_1$, comparator 42 produces an equality pulse when the count state of counter 21 reaches the boundary address $N_2$. This equality pulse is applied on conductor 43 to the reset input of flip-flop 37. Since this flip-flop was set in response to the operation of key 34, the signal on the Q output is high until the boundary address $N_2$ is accessed. Accordingly, during the period from time $t_1$ to $t_2$, flip-flop 37 remains in its initially set condition and a high level output apppears on the input of an envelope generator 38.

Figure 4:
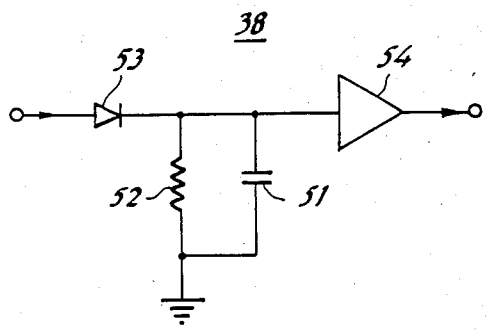
FIG. 4 is a circuit diagram of the envelope generator of FIG. 3.
Figure 5:
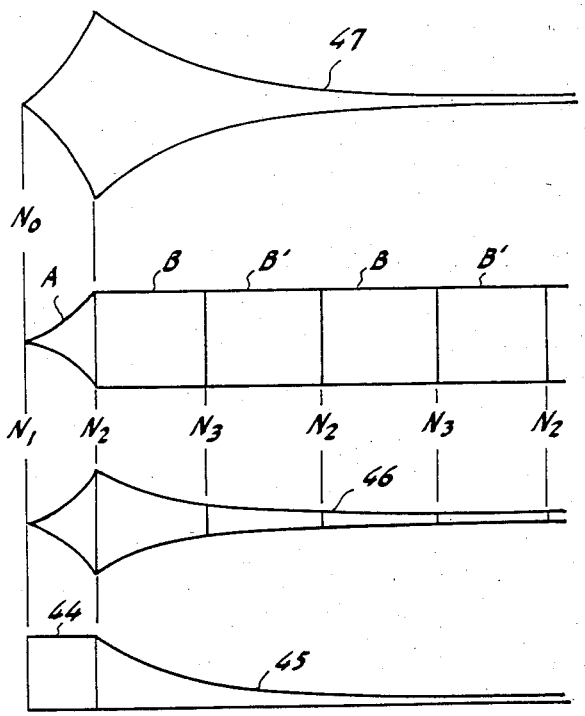
FIG. 5 shows output waveforms of low and high frequency components and the envelope impressed on the higher frequency components.

As shown in FIG. 4, envelope generator 38 includes a parallel combination of capacitor 51 and resistor 52 connected through a diode 53 from the Q output of flip-flop 37 to ground. The high voltage signal from flip-flop 37 charges capacitor 51, developing a voltage plateau 44 (FIG. 5) as long as the Q output of flip-flop 37 remains high. The resetting of flip-flop 37 by the output of comparator 42 causes capacitor 51 to discharge through resistor 52, developing an exponentially decaying voltage 45. The envelope thus generated is coupled through a buffer amplifier 54 to the control terminals of an analog multiplier, typically a variable gain amplifier 39, and a variable frequency filter 40.

Variable gain amplifier 39 takes its input from the low-pass filter 41 to impress the envelope developed by envelope generator 38 upon the analog amplitudes by a variable ratio which ranges from unity to zero. Amplifier 39 provides a unity gain amplification when it is supplied with the voltage plateau and reduces its gain in proportion to the decaying voltage. Thus, the reconstructed initial waveform section A is unaffected by variable gain amplifier 39 and the subsequent portion of the reconstructed waveform comprising a series of recycled waveform sections B and B′ are reduced monotonically as shown at 46 by the exponentially declining voltage 45.

The output of variable gain amplifier 39 is applied to variable frequency filter 40. This filter has the characteristic of a low-pass filter. However, the cut-off frequency of this low-pass filter follows an exponential curve similar to curve 45; namely, it shifts toward lower frequency in proportion to decaying voltage 45. The output of variable gain amplifier 39 has an equalized spectral characteristic since it only affects the amplitude of the analog signal. Variable frequency filter 40, on the other hand, modifies this frequency characteristic in accordance with the decaying waveform so that the harmonic content of the reconstructed analog waveform decreases monotonically with time. Since the original waveform sections A and B have a larger content of higher harmonics than in the eliminated tail portion of the waveform 6, the spectral characteristic of the output of variable frequency filter 40 substantially conforms to the spectral characteristic of the original waveform. The monotonic decrease both in amplitude and higher harmonic content approximates the waveform generated according to the present invention to natural percussive sounds. In addition, the period of the recycled waveform section is longer than the minimum period of the audible frequency. As a result, there is no audible flutter frequency in the regenerated aperiodic waveform. The higher frequency analog waveform 46 is combined with a lower frequency analog waveform shown at 47 in FIG. 5 at summing point 56 to produce a waveform which is a replica of the original waveform 1.

It is found that the human's audibility in terms of phase variation is very poor at frequencies lower than 1000 Hz. Therefore, a phase variation of the higher frequency waveform 46 which may be caused by the recycled reading operation is unnoticeable by human ears.

Figure 6:
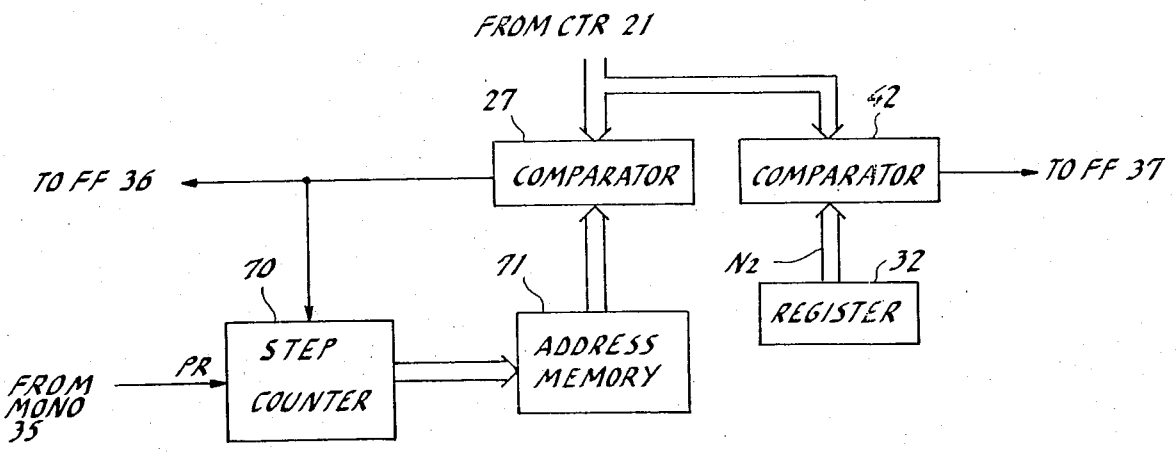
FIG. 6 is a block diagram of a modified embodiment.

FIG. 6 shows an alternative form of the previous embodiment. Selector 28 and register 33 are replaced with a step counter 70 and an address memory 71. Step counter 70 is preset by the output of monostable multivibrator 35 to an initial count from which it begins to count up in response to the output of comparator 27. Address memory 61 may store a series of address codes $N_3$ and $N_2$ to read the address field of memory 20 in a manner identical to the previous embodiment. However, the flexibility of memory 61 allows a series of pseudo-random address codes to be stored and accessed in sequence to scan different sections of the recycled portion of the waveform. For example, the pseudo-random codes may include a boundary address $N_3$ for reversal at the end of initial forward scan and a boundary address $N_2$ for reversal at the end of first rearward scan and subsequent boundary addresses which are randomly located between the boundary addresses $N_2$ and $N_3$. As a result of this pseudo-random addressing, portions of different length in the waveform section B are rescanned so that each scan partially overlaps adjacent scans.

The foregoing description shows only preferred embodiments of the present invention. Various modifications are apparent to those skilled in the art without departing from the scope of the present invention which is only limited by the appended claims. For example, the envelope impression circuit may be constructed of a digital circuit to multiply a digital multiplication factor upon digital amplitudes delivered from the waveshape memory 20. Variable frequency low-pass filter could equally be as well constructed of a digital filter to modify the frequency characteristic of the digital amplitudes from the memory.

What is claimed is:

1. An electronic musical instrument comprising:

a first memory with a plurality of amplitude data stored at sequentially addressible locations of the first memory, the amplitude data stored in the first memory representing the amplitudes of lower frequency components of a section of a percussive waveform;

a second memory with a plurality of amplitude data stored at sequentially addressible locations of first and second portions of the second memory, the amplitude data stored in said first portion representing the amplitudes of higher frequency components of a rising section of said percussive waveform and the amplitude data stored in said second portion representing the amplitudes of said higher frequency components of a second section of the percussive waveform which immediately follows said rising section, a phase variation of said higher frequency components being unnoticeable by human ears;

first memory address means for addressing said first memory at a lower rate and generating from said first memory a first output waveform corresponding to the waveform of the lower frequency components;

second memory address means for addressing the first and second portions of said second memory at a higher rate in forward scan and subsequently recyclically addressing the second portion in rearward and forward scans and generating from said second memory a second output waveform having a first part corresponding to said rising section of the waveform of the higher frequency components and a second part corresponding to a series of the recyclically addressed versions of said second section of said higher frequency waveform; and means for combining said first and second output waveforms.

2. An electronic musical instrument as claimed in claim 1, wherein the amplitude data stored in the first portion of said second memory represents the amplitudes and the spectral energy distribution profile of said rising section of said higher frequency waveform and the amplitude data stored in the second portion of said second memory represents the amplitudes and the spectral energy distribution profile of said second section of the higher frequency waveform, the amplitudes of the second section of the higher frequency waveform having equal peak values and the spectral energy distributions of said second portion being substantially equalized, further comprising:

variable gain amplifier means for impressing a monotonically declining envelope upon the amplitudes of said second part of said second output waveform, and variable frequency filter means for impressing a monotonically declining profile upon the spectral energy distribution profile of said second part of said second output waveform, said variable gain amplifier and said variable frequency filter means being connected in circuit to said second memory so that said first part of said second output waveform and the outputs of said variable gain amplifier means and said variable frequency filter means form an aperiodic waveform of said higher frequency components.

3. An electronic musical instrument as claimed in claim 1, wherein said second memory address means comprises:

a reversible counter for addressing said second memory in forward and rearward scans; and means for reversing said forward scan at a first boundary point of the locations of the second memory and reversing said rearward scan at a second boundary point of the memory locations and repeating the reversals at said first and second boundary points.

4. An electronic musical instrument as claimed in claim 2, wherein said second memory address means comprises:

a reversible counter for addressing said second memory in forward and rearward scans; and means for reversing said forward scan at a first boundary point of the locations of the second memory and reversing said rearward scan at a second boundary point of the memory locations and repeating the reversals at said first and second boundary points.

5. An electronic musical instrument as claimed in claim 4, further comprising means for detecting the initial forward scan reaching said second boundary point, wherein said variable gain amplifier means and said variable frequency filter means comprise an envelope generator responsive to the detection of said initial forward scan reaching said second boundary point to generate a signal having a monotonically declining amplitude, said variable gain amplifier means multiplying said second part of the second output waveform by a fraction which is a function of said monotonically declining amplitude, and said variable frequency filter means comprising a variable frequency low-pass filter for passing said second part of the second output waveform therethrough, the cut-off frequency of the low-pass filter being decreased as a function of said monotonically declining amplitude.

6. An electronic musical instrument as claimed in claim 1, wherein said second memory address means comprises:

a reversible counter for sequentially generating an address code to access said memory locations of the second memory in forward and rearward scans;

an address memory with a plurality of boundary address codes respectively stored in sequentially addressible memory locations;

a second counter for sequentially addressing said address memory; and a comparator coupled to said reversible counter and to said address memory to generate a coincidence output representing the occurrence of a coincidence between the data address code and the boundary address code addressed by said second counter and stepping said second counter in response to said coincidence.

* * * * *